United States Patent [19]

Pfeiffer

[11] 4,278,415

[45] Jul. 14, 1981

[54] APPARATUS FOR MELT SPINNING HOLLOW FIBERS

[75] Inventor: Ronald E. Pfeiffer, Pensacola, Fla.

[73] Assignee: American Cyanamid Company, Stamford, Conn.

[21] Appl. No.: 13,353

[22] Filed: Feb. 21, 1979

[51] Int. Cl.[3] ..... A01J 21/00

[52] U.S. Cl. ..... 425/466; 264/177 F

[58] Field of Search ..... 264/177 F; 425/466

[56] References Cited

U.S. PATENT DOCUMENTS

| | | | |
|---|---|---|---|
| 1,618,256 | 2/1927 | Wurthrich | 425/DIG. 217 |
| 3,075,242 | 1/1963 | Grafried | 264/171 |
| 3,121,254 | 2/1964 | Heynen et al. | 264/171 |
| 3,438,087 | 4/1969 | Attfield et al. | 425/DIG. 217 |
| 3,439,381 | 4/1969 | Plomp | 264/177 F |
| 3,540,080 | 11/1970 | Goossens | 264/171 |
| 3,608,040 | 9/1971 | Green | 264/177 F |
| 3,686,377 | 8/1972 | Hays | 264/177 F |
| 4,151,242 | 4/1979 | Sansone | 264/177 R |

FOREIGN PATENT DOCUMENTS

| | | | |
|---|---|---|---|
| 43-30025 | 12/1968 | Japan | 264/171 |
| 45-15804 | 6/1970 | Japan | 264/171 |
| 47-31365 | 8/1972 | Japan | 264/177 F |

*Primary Examiner*—Jay H. Woo

*Attorney, Agent, or Firm*—Frank M. Van Riet

[57] ABSTRACT

Using a conventional spinneret plate with suitable pins inserted in the counterbore-orifice combination thereof, hollow fibers are provided.

2 Claims, 5 Drawing Figures

APPARATUS FOR MELT SPINNING HOLLOW FIBERS

Figure 1:
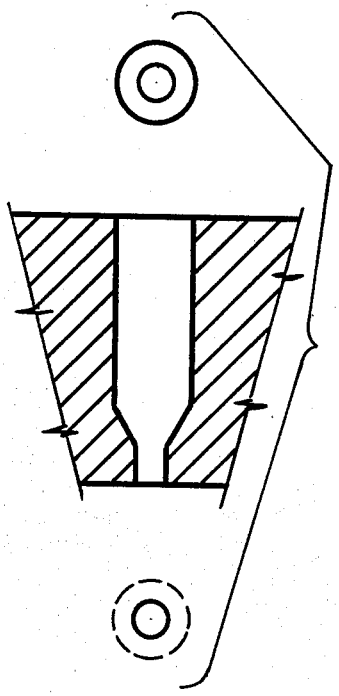

This invention relates to apparatus for forming hollow fibers. More particularly, this invention relates to such apparatus useful in preparing hollow fibers from a fusion melt of acrylonitrile polymer and water.

Recent developments in the art of spinning acrylonitrile polymer fiber have led to a fusion melt spinning procedure. In this procedure, an acrylonitrile polymer and water in proper proportions are heated to a temperature above the boiling point of water at atmospheric pressure and under sufficient pressure to maintain water in liquid state. At appropriate temperature and pressure a homogeneous fusion melt of polymer and water will form at a temperature below the deterioration temperature of the polymer and at a temperature below which the polymer would normally melt. In preferred embodiments this fusion melt is extruded through a spinneret directly into a steam-pressurized solidification zone maintained under conditions which prevent formation of sheat-core structure in the cross-section of the nascent extrudate and enable stretching to provide orientation of the polymer molecules to be accomplished while said extrudate remains within the solidification zone. This process provides a rapidly solidified extrusion composition which upon exit from the spinnerette shows no tendency towards stickiness and high conformity to the shape of the spinneret orifices through which it is spun.

Hollow fibers are desirable for a number of reasons. Such fibers generally have low density and, accordingly, have high bulk relative to solid fibers of the same denier. Added bulk increases insulating qualities of the fiber while providing low weight. As a result, such fibers are highly desirable in wearing apparel wherein they provide increased comfort due to the combination of low weight and increased bulk. They also can provide increased moisture absorption, wicking, improved soil hiding qualities, and improved esthetics such as handle or feel and internal sparkle or reflectance.

Spinnerettes useful in providing hollow fibers are extremely difficult to construct and require extremely expensive techniques to fabricate. Because of these restrictions very limited production of hollow fibers has been evidenced. What is needed is an apparatus for spinning hollow fibers that is easily constructed and enables wide versatility in the types of hollow fibers provided. Such a provision would fulfill a long-felt need and constitute a significant advance in the art.

In accordance with the present invention, there is provided a spinnerette assembly for spinning hollow fibers which comprises in combination:

a. a spinnerette plate containing a plurality of orifices with a counterbore for each orifice and b. removable pins positioned within each orifice-counterbore combination, each pin being of solid construction and having an upper portion positioned within said counterbore and a lower portion positioned within said orifice, said upper portion occupying a fine position within said counterbore and enabling spinning composition to flow through the counterbore to the orifice at operative back pressure and said lower portion being spaced from the orifice wall to provide a hollow extrudate.

The spinnerette assembly of the present invention is readily fabricated since it employs a conventional type spinnerette plate and employs easily prepared pins for insertion therein. The spinnerette assembly when employed with a fusion melt of acrylonitrile polymer and water enables a wide variety of hollow fibers to be obtained by suitable selection of spinnerette plate and pin inserts since the polymer-water extrudate quickly solidifies to retain the shape imparted by the spinnerette orifices after extrusion. In a preferred embodiment, the extrudates of acrylonitrile polymer and water are spun directly into a steam-pressurized solidification zone which prevents formation of a sheath-core structure and enables the extrudate to be stretched to provide orientation of the polymer molecules. Water evaporating from the extrudate within the hollow provided therein keeps the hollow open during processing and added fluid does not need to be injected into the hollow to retain its structure. As a result, processing is more readily accomplished using the spinnerette assembly of the present invention and requires much less complicated equipment. The fibers have essentially 100% hollow structure and the benefits of hollow structure are greatly accentuated.

The invention is more fully described with reference to the drawings in which

Figure 2:
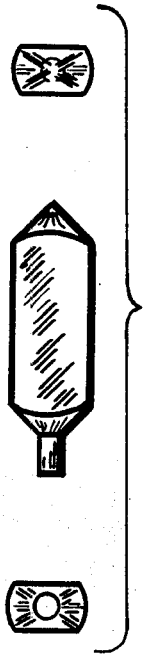
Figure 3:
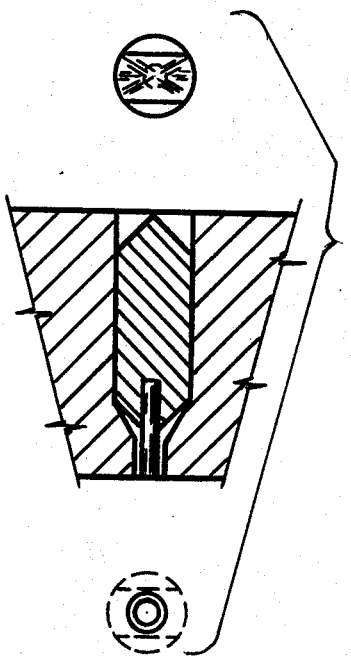
Figure 4:
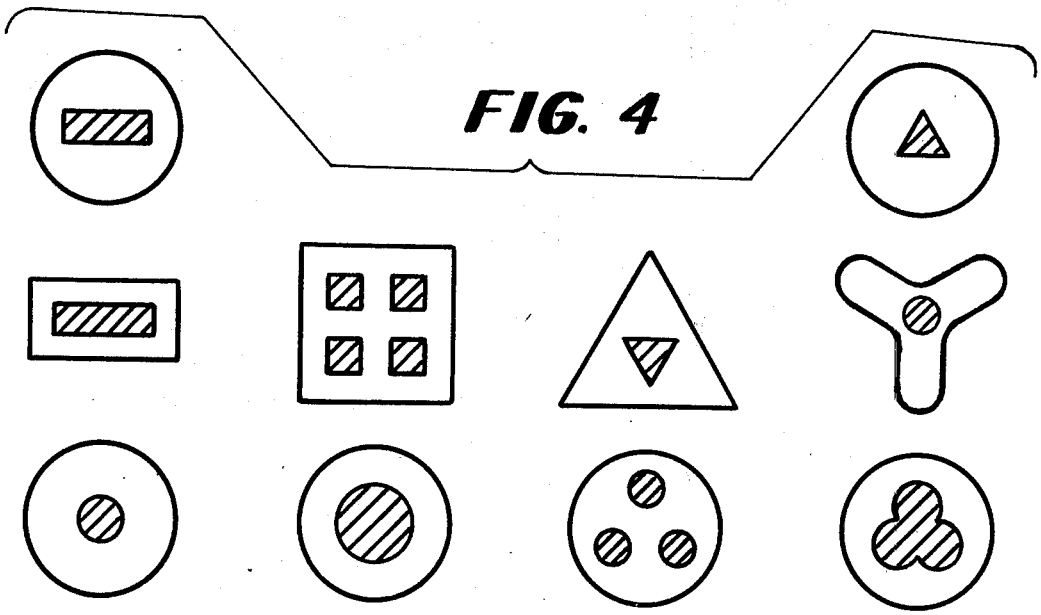

FIG. 1 represents a cross-section of a portion of a spinnerette plate showing a single counterbore and orifice as well as top and bottom view thereof, FIG. 2 represents a slide view of a typical insertion pin as well as top and bottom views thereof, FIG. 3 represents a cross-section of a single counterbore and orifice with insertion pin positioned therein as well as a top and bottom view thereof, and FIG. 4 represents the bottom view of a number of shaped orifices having a variety of shaped pins inserted therein.

In providing the spinnerette assembly of the present invention, a conventional type spinnerette plate is employed. The spinnerette plate will contain a plurality of orifices and a counterbore associated with each orifice. The spinnerette plate may have orifices of any shape that can be effectively fabricated using conventional procedures and will be of a material of construction useful in melt-spinning applications. Counterbores are necessary to provide operative back pressure and should be large enough to enable the pin insert modification to allow operative back pressure.

Pins are provided for insertion in the counterbore-orifice combination to provide extrudates having hollow cores. These pins are designed so that they are of solid construction and occupy a fixed position within the counterbore. The pins will be of such size as to enable extrusion composition to flow through the counterbores at operative back pressure to the orifice. The pins typically will have an upper portion which fits into the counterbore and a lower portion which fits into the orifice. The upper portion will be of suitable dimensions to assume a fixed position within the counterbore so that the lower portion remains suitably disposed in the orifice to provide the hollow fiber and enable adequate flow of extrusion compositon through the counterbore and capillary. The lower portion of the pin will be of suitable dimensions to fit within the orifice and to provide clearance from the wall thereof so that a proper relationship between fiber wall and hollow therein is obtained.

A preferred embodiment of the invention is that shown with reference to FIGS. 1, 2, and 3. FIG. 1 represents a cross-section of a typical counterbore-orifice combination used in a conventional spinnerette plate, as well as top and bottom views thereof. The counterbore has a greatly enlarged diameter relative to that of the orifice and converges to the orifice diameter with proper sloping. FIG. 2 represents a side view of a preferred pin insert to provide hollow fibers when inserted within the counterbore-capillary combination, as well as top and bottom views thereof. As can be seen, the upper portion of the pin resembles a cylindrical rod which has been flattened along its length to provide clearance on two sides within the counterbore. The top of the upper portion is beveled while the bottom thereof is tapered at a greater angle than the taper of the counterbore to connect the orifice and thus provide clearance for the extrusion material. The bottom portion of the pin is a round rod providing clearance from the wall of the orifice to provide a solid core therein. In FIG. 3, the insertion of the pin of FIG. 2 in the counterbore-capillary combination of FIG. 1 is shown in cross-section along with top and bottom views thereof. Clearance of the pin from the counterbore wall is shown in the top view and clearance between the tapers of the pin and counterbore are shown. In the bottom view the space between the two inner circles represents the wall thickness of the extrudate as spun.

In FIG. 4 are shown a variety of orifice shapes with various shapes of the lower portion of the insert pin that can be used in providing hollow fibers. As can be seen, the pin shape may vary widely as well as the orifice shape. Also, it is possible to provide one or more hollows within the fiber by use of multiple projections as the lower portion of the pin insert.

The spinnerette assembly of the present invention is preferably employed using a fusion melt of fiber forming acrylonitrile polymer and water. This composition is formed by heating proper amounts of polymer and water at autogeneous pressure and a temperature above the boiling point of water at atmosphere pressure in a suitable extruder. The extruder forces the homogeneous single-phase fusion melt through a spinnerette assembly equipped with the spinnerette plate and pin inserts described above. Extrusion is preferably carried out so that the nascent extrudate enters directly into a stream-pressurized solidification zone maintained under conditions which prevent formation of a sheath-core structure fiber and enables orientation stretching of the extrudate to be accomplished while the extrudate remains in the solifification zone. After the extrudate leaves the solidification zone, it is preferably dried under proper conditions of dry and wet-bulb temperatures to minimize void formation in the resulting fiber and relaxed in steam. The fiber can be provided in desirable textile deniers with desirable physical properties for such use.

The invention is more fully illustrated by the examples which follow wherein all parts and percentages are by weight unless otherwise specified.

EXAMPLE 1

A conventional spinneret plate having a plurality of orifices of 300 micron diameter was fitted with insert pins as shown in FIG. 3. Each pin was 175 micron in diameter resulting in free area remaining in the individual capillaries of about 46,633 square microns.

Acrylonitrile polymer of the following composition was employed:

Acrylonitrile: 85%
Methyl methacrylate: 11.9%
Poly (vinyl alcohol): 3.0%
Acrylamedomethylpropanesulfonic acid : 0.1% The polymer had a kinematic molecular weight of 40,000. Kinematic molecular weight ($\overline{M}_k$) is determined from the viscosity measurement of a 1% solution of the polymer in 50% sodium thiocyanate at 40° C. using the formula: $\overline{M}_k = V \times 10{,}500$, where V is the absolute viscosity in centipoise (after correction for viscometer constant).

Figure 5:
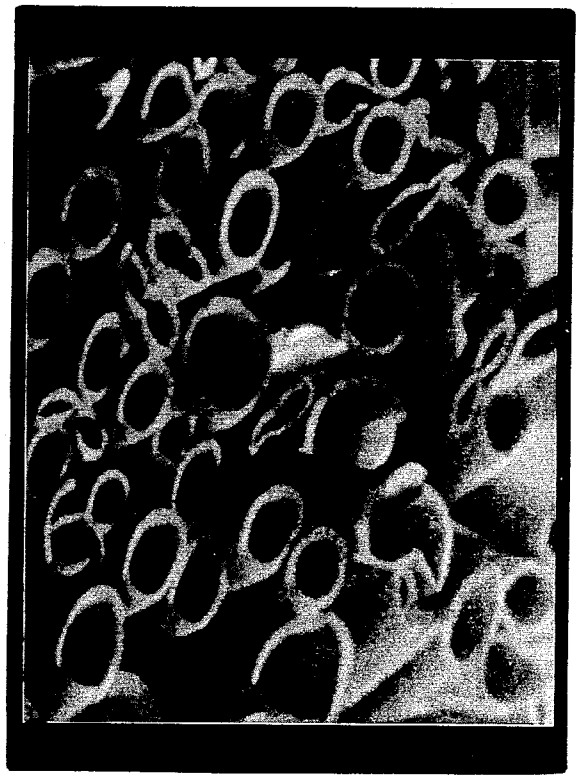

A mixture of 84.6 parts polymer, 15.4 parts water and 0.25 parts of a conventional glycol stearate type lubricant was converted to a fusion melt in an extruder at 167° C. and autogeneous pressure and extruded through the spinneret plate prepared as described above directly into a steam pressurized solidification zone maintained at 13 pounds per square inch gauge with saturated steam. The resulting filaments were stretched, at a stretch ratio of 9.2 in a first stage and 6.4 in a second stage to give a fiber of about 6.5 denier. The fiber was dried at 139° C. dry bulb/74° C. wet bulb and steam relaxed at 16° C. The final 9 denier fiber obtained was hollow as shown in FIG. 5.

We claim:

1. A spinnerette assembly for spinning hollow fibers which comprises in combination a. a spinnerette plate containing a plurality of orifices with a counterbore for each orifice and, b. removable pins positioned within each orifice-counterbore combination, each pin being of solid construction and having an upper portion positioned within said counterbore and a lower portion positioned within said orifice, said upper portion occupying a fixed position within said counterbore and enabling spinning composition to flow through the counterbore to the orifice at operative back pressure and said lower portion being spaced from the orifice wall to provide a hollow extrudate.

2. The spinnerette assembly of claim 1 wherein said pin has an upper portion which resembles a cylindrical rod which has been flattened along its length to provide clearance on two sides with the counterbore is beveled at the top and is tapered at the bottom at a greater angle than the taper of the counterbore and the bottom portion is a round rod providing clearance from the wall of the orifice to provide a solid core therein.

* * * * *